US005472213A

United States Patent [19]

Dudley

[11] Patent Number: 5,472,213

[45] Date of Patent: Dec. 5, 1995

[54] MAGNETICALLY CONTROLLED EXPANDABLE ARROWHEAD

[76] Inventor: Jerome M. Dudley, 210 N. Pleasant Ave., Galesburg, Ill. 61401

[21] Appl. No.: 311,260

[22] Filed: Sep. 23, 1994

[51] Int. Cl.[6] ..... F42B 6/08

[52] U.S. Cl. ..... 273/421

[58] Field of Search ..... 273/421, 422

[56] References Cited

U.S. PATENT DOCUMENTS

| | | | |
|---|---|---|---|
| 3,578,328 | 5/1971 | Rickey | 273/421 |
| 4,166,619 | 9/1979 | Bergmann et al. | 273/421 X |
| 4,643,435 | 2/1987 | Musacchia | 273/422 |
| 4,940,246 | 7/1990 | Stagg | 273/421 |
| 5,078,407 | 1/1992 | Carlston et al. | 273/421 |

*Primary Examiner*—Paul E. Shapiro

[57] ABSTRACT

An expandable arrowhead having a magnetic source capable of holding attached triangular shaped blades in a closed or open position relative to the magnetic strip's fixed location beneath and between parallel opposing slots in the wall of a hollow metal shaft.

1 Claim, 1 Drawing Sheet

MAGNETICALLY CONTROLLED EXPANDABLE ARROWHEAD

DESCRIPTION

1. Technical Field

The invention relates to archery equipment and more particularly to a special purpose combination expandable arrowhead capable of movement under constant control of a magnetic strip to which the blades are attached when the magnetic strip is bedded in a hollow arrow shaft, the shaft having parallel opposing slots in it's wall to allow portions of the blades to move in and out of the confines of said shaft.

2. Background Art

Expandable arrowheads in the prior art were mechanically controlled from within the arrow shaft or externally controlled by O rings. It is the object of the invention to devise an expandable arrowhead that is non-mechanically operated while controlling in part the position of the expandable blades at all times by means of a magnetic strip to which movable blades are attached.

DISCLOSURE OF THE INVENTION

The object of the invention has been met by a magnetically controlled expandable arrowhead comprising in combination a shaped magnetic strip having a pair of triangular shaded blades affixed thereto, the blades sharing a common axis provided by a pin fitted in and through matching holes located in the base area of said blades and extending through said magnetic strip and a magnetic spacer into matching opposing holes in the wall of a shaft. The flat surface of said magnetic strip with it's attached movable blades is located within said shaft on a plane even with opposing parallel slots in the wall of said shaft, the slots allowing said blades to move partly in and out of the confines of said shaft. Length of said slots govern in part the open and closed positions of said blades while the magnetic strip is held captive within said shaft by it's anchor pin, adhesives and walls located at each end of said magnetic strip within the confines of said hollow shaft.

BEST MODE FOR CARRYING OUT THE INVENTION

Figure 1:
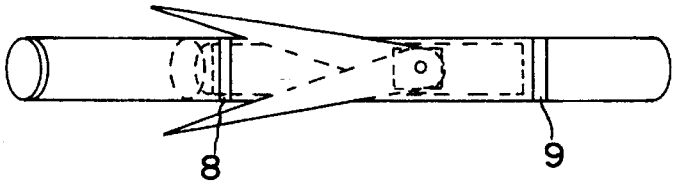
FIG. 1 is a top see through view of the magnetically expandable arrowhead with blades in a closed mode and with end walls securing unit in position between opposing parallel slots in the wall of the shaft.

With reference to FIG. 1 one embodiment of the magnetically expandable arrowhead is it's non-mechanical means 1 and 4 for controlling the position of the expandable blades 3.

Figure 2:
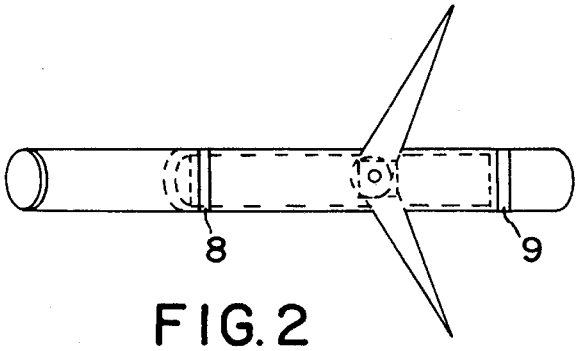
FIG. 2 is a top see through view of the magnetically expandable arrowhead with blades expanded.

With reference to FIG. 2 showing blades 3 in expanded position the magnetic strip 1 is secured in it's position by fixed walls 8 and 9 at it's ends permanent pin 6 through holes 2.

Figure 3:
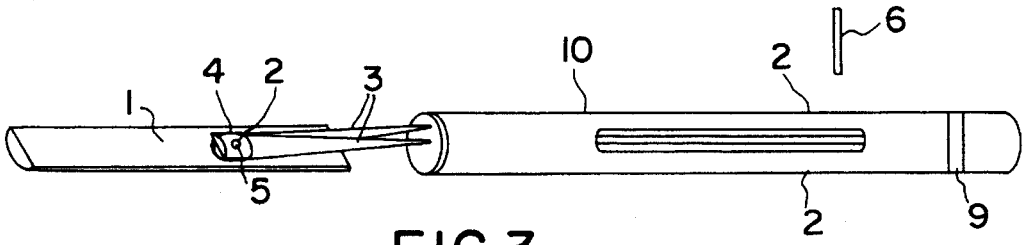
FIG. 3 shows the magnetic spacer and pin holding the blades in a reversed position on the magnetic strip prior to installation in the slotted shaft.

With reference to FIG. 3 showing blades 3 in reverse position on magnetic strip 1 prior to entry into slotted shaft 10 with it's waiting pin 6 said pin 6 will replace pin 5 after pin 5 is lined up with holes 2 thus helping to anchor blades 3 and magnetic parts 1 and 4 to shaft 10.

Figure 4:
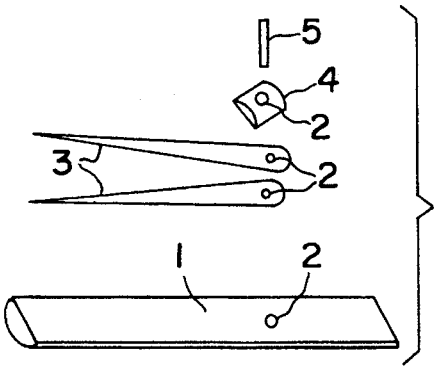
FIG. 4 shows the magnetic strip and it's anchor pin hole along with the blades, magnetic spacer and temporary anchor pin.

With reference to FIG. 4 the sequence for assembly is shown involving magnetic strip 1 whose anchor hole 2 will be in alignment with holes 2 in blades 3 and hole 2 in magnetic spacer 4 prior to insertion of temporary pin 5 into holes 2 extending through components 4, 3 and 1.

While various changes may be made in the detailed construction it shall be understood that such changes shall be within the spirit and scope of the present invention as defined by the appended claims.

What I claim as new and desire to protect by Letters Patent of the United States is:

1. An expandable arrowhead comprising:

a. an elongate tubular shaft defined by a encircling wall;

b. a pair of diametrically located elongate slots in the wall of the shaft at the forward end thereof;

c. an elongate magnetic strip located within the shaft longitudinally aligned with and extending the length of the slots spanning the shaft between the slots;

d. a pair of overlapping triangular blades located in the shaft, overlying the magnetic strip, having their bases overlapping and positioned adjacent the rear end of the slots, the blades extending forwardly from the bases thereof to pointed leading ends, the leading ends of the blades extending outwardly from the shaft in opposite directions, each through one of the slots;

e. a magnetic spacer element overlying the bases of the blades;

f. aligned holes in each of the magnetic strip, blade bases, magnetic spacer and in diametrically opposed portions of the shaft wall; and g. a pin extending the through the aligned holes for securing the magnetic strip, blades, and magnetic spacer element to the shaft whereby the magnetic strip and spacer cooperate to hold the blades partly within the shaft during flight and the blades may pivot about the pin upon impact with a target to extend outwardly of the shaft.

* * * * *